US008682007B2

(12) United States Patent
Akino

(10) Patent No.: US 8,682,007 B2
(45) Date of Patent: Mar. 25, 2014

(54) CONDENSER MICROPHONE UNIT

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 214 days.

(21) Appl. No.: 13/067,324

(22) Filed: May 25, 2011

(65) Prior Publication Data

US 2011/0293114 A1 Dec. 1, 2011

(30) Foreign Application Priority Data

May 27, 2010 (JP) ..... 2010-121943

(51) Int. Cl.

| | |
|---|---|
| ***H04R 3/00*** | (2006.01) |
| ***H04R 1/00*** | (2006.01) |
| ***H04R 9/06*** | (2006.01) |
| ***H04R 11/02*** | (2006.01) |

(52) U.S. Cl.

USPC ..... 381/111; 381/398

(58) Field of Classification Search

USPC ..... 381/398, 111

See application file for complete search history.

(56) References Cited

U.S. PATENT DOCUMENTS

| | | | | |
|---|---|---|---|---|
| 2006/0050920 | A1* | 3/2006 | Akino | 381/396 |
| 2007/0201710 | A1* | 8/2007 | Suzuki et al. | 381/174 |
| 2009/0190782 | A1* | 7/2009 | Suzuki et al. | 381/174 |

FOREIGN PATENT DOCUMENTS

| | | | |
|---|---|---|---|
| JP | S58-107698 | U | 7/1983 |
| JP | 2001-313999 | A | 11/2001 |
| JP | 2006-060370 | | 3/2006 |
| JP | 2006-332930 | A | 12/2006 |

OTHER PUBLICATIONS

Japan Patent Office, "Office action for JP2010-121943," Jan. 10, 2014.

* cited by examiner

*Primary Examiner* — Duc Nguyen
*Assistant Examiner* — Sean H Nguyen
(74) *Attorney, Agent, or Firm* — Manabu Kanesaka

(57) ABSTRACT

This invention provides a condenser microphone unit having a diaphragm assembly in which a diaphragm does not attach to a fixed electrode even if a polarization voltage is increased. A condenser microphone unit is provided having a diaphragm assembly 1 in which a diaphragm 12 is stretched over a diaphragm support 10 and a fixed electrode 20 arranged to face the diaphragm assembly 1 through a spacer. An opening 10*a* over which the diaphragm 12 is stretched so as to be able to vibrate is formed in the diaphragm support 10, the diaphragm 12 is stretched over the diaphragm support 10 in a situation where a central part of the diaphragm is dented to be concave, and the concave is arranged to face the fixed electrode 20.

5 Claims, 11 Drawing Sheets

CONDENSER MICROPHONE UNIT

RELATED APPLICATIONS

The present application is based on, and claims priority from, Japanese Application No. JP2010-121943 filed May 27, 2010, the disclosure of which is hereby incorporated by reference herein in its entirety.

BACKGROUND OF THE INVENTION

1. Field of the Invention

The present invention relates to a condenser microphone unit.

2. Description of the Related Art

A conventional condenser microphone is provided with a condenser microphone unit having a diaphragm assembly 100 in which a diaphragm 12 is stretched taut over a metal diaphragm support 13A to have predetermined tension, a fixed electrode 20, and a spacer ring (spacer) 30, as shown in FIG. 7.

Further, in the above-mentioned condenser microphone unit, the diaphragm 12 of the diaphragm assembly 100 and the fixed electrode 20 are arranged to face each other through the spacer ring 30.

Furthermore, a support ring formed in a ring shape is used for the above-mentioned diaphragm support 13A. In a situation where predetermined tension is applied to the diaphragm 12, its circumferential edge is adhered to the above-mentioned support ring by means of an adhesive.

As for the diaphragm 12 adhered to the diaphragm support 13A as described above, an area inside the diaphragm support 13A is arranged to operate as an effective vibrating portion (between itself and the fixed electrode 20, it acts as an effective electrostatic-capacitance portion).

Incidentally, the above-mentioned condenser microphone has a structure with which high sensitivity is obtained by increasing (raising) a polarization voltage between the diaphragm 12 and the fixed electrode 20.

However, electrostatic attraction (electrostatic attraction which increases with increasing polarization voltage) takes place between the diaphragm 12 and the fixed electrode 20. Therefore, there arises a problem in that, as shown in FIG. 8, if a voltage greater than a predetermined polarization voltage is applied across the diaphragm 12 and the fixed electrode 20, the diaphragm 12 is pulled by the electrostatic attraction toward the fixed electrode 20 side and then brought into contact therewith, so that the condenser microphone stops operating. In particular, a central part of the diaphragm 12 with weak tension is pulled towards the fixed electrode 20 side and comes into contact therewith. In addition, for convenience of description, the spacer ring 30 is not shown in FIG. 8.

Japanese Patent Application Publication No. 2006-60370 (patent document 1) proposes a structure of the condenser microphone unit which solves the above-mentioned problem.

In particular, the condenser microphone unit of patent document 1 is arranged such that a diaphragm support 13B which stretches the diaphragm 12 tightly is provided with a plurality of openings 13B1 as shown in FIG. 9 to thereby increase vibration tension of the diaphragm 12.

However, even if the plurality of openings 13B1 are provided for the diaphragm support 13B to increase the vibration tension of the diaphragm 12 as in patent document 1 above, the diaphragm 12 cannot sufficiently counter the electrostatic attraction generated in the condenser microphone which has narrow directivity and needs high sensitivity, is attracted by the fixed electrode 20, and may come into contact therewith (see FIG. 10).

In addition, since the polarization voltage is around 600V in the condenser microphone with narrow directivity using a sound tube, the above-mentioned electrostatic attraction is large.

In other words, the condenser microphone unit disclosed in patent document 1 has a technical problem in that when it is used for the condenser microphone with narrow directivity and high polarization voltage, the central part (central part where tension is small) of the diaphragm 12 is pulled by electrostatic attraction toward the fixed electrode 20 side and may come into contact therewith (attach thereto).

SUMMARY OF THE INVENTION

The present invention arises in order to solve the above-mentioned technical problem and an object of the present invention is to provide a condenser microphone unit having a diaphragm assembly in which a diaphragm does not attach to a fixed electrode even if a polarization voltage is increased.

Another object of the present invention is to provide a method of manufacturing a diaphragm assembly in which a diaphragm does not attach to a fixed electrode even if a polarization voltage is increased.

A feature of the present invention made in order to solve the above-mentioned problem is a condenser microphone unit having a diaphragm assembly in which a diaphragm is stretched over a diaphragm support and a fixed electrode arranged to face the above-mentioned diaphragm assembly through a spacer, wherein an opening over which the above-mentioned diaphragm is stretched so as to be able to vibrate is formed in the above-mentioned diaphragm support, and the above-mentioned diaphragm is stretched over the above-mentioned diaphragm support in a situation where a central part of the above-mentioned diaphragm is dented to be concave, and the above-mentioned concave is arranged to face the above-mentioned fixed electrode.

According to the above-described structure, the central part of the diaphragm can be separated from the fixed electrode (a spacing between the central part of the diaphragm and the fixed electrode can be increased).

The reason why the above-mentioned structure in which the spacing between the central part of the diaphragm and the fixed electrode is selected to be large is as follows.

That is, the present inventor has found that "stability (value indicating how well the diaphragm provides desired performance (sensitivity) without the fixed electrode attaching) to the attaching" is proportional to a third power (cube) of the above-mentioned spacing and is inversely proportional to a second power (square) of the polarization voltage and that the above-mentioned increased spacing is effective to prevent the diaphragm from attaching to the fixed electrode.

In addition, it is arranged that if the stability is greater than a predetermined range, the performance (sensitivity) of a microphone falls, and if it is smaller than the predetermined range, the diaphragm attaches to the fixed electrode.

Thus, according to the condenser microphone unit of the present invention, it is possible to prevent the diaphragm from attaching to the fixed electrode, even if a high polarization voltage is applied across the diaphragm and the fixed electrode.

Therefore, by installing the condenser microphone unit of the present invention, it is possible to prevent failure of the condenser microphone which requires high sensitivity.

Further, it is desirable that the above-mentioned diaphragm support is formed in the shape of a plate whose central part is dented, and the above-mentioned opening is constituted by a plurality of through holes bored across the front and back.

Furthermore, it is desirable that one of the above-mentioned plurality of through holes is arranged in the center of the above-mentioned diaphragm support, and the rest of the through holes are arranged around the perimeter of the through hole in the center.

As described above, by employing the structure in which the central part of the above-mentioned diaphragm support is dented, the above-mentioned diaphragm can be stretched in a situation where the central part of the diaphragm is dented to be concave.

Further, by providing the opening constituted by the plurality of through holes, the diaphragm can be stretched so as to be able to vibrate partially. As a result, the vibration tension of the diaphragm can be increased.

Furthermore, the present invention made in order to solve the above-mentioned problem is a method of manufacturing a diaphragm assembly used for a condenser microphone, comprising a first step of setting on a surface plate a diaphragm support which is formed in the shape of a plate with an even thickness and has an opening perforated across the front and back, polishing the diaphragm support applying stress to a central part of the above-mentioned diaphragm support, and causing the central part of the above-mentioned diaphragm support to dent; a second step of placing on a jig a diaphragm formed of a resin film which has a metal deposition film, applying an adhesive to the dented side of the diaphragm support which is obtained by way of the above-mentioned first step and whose central part is dented, bringing the above-mentioned adhesive-applied side into abutment with the above-mentioned diaphragm, applying a load to the central part of the above-mentioned diaphragm support and the above-mentioned diaphragm from an opposite side of said adhesive-applied side of the above-mentioned diaphragm support and depressing them until predetermined time has elapsed; and a third step of cutting the diaphragm protruding from the outer periphery of the above-mentioned diaphragm support after the above-mentioned predetermined time, and taking out the diaphragm assembly in which the above-mentioned diaphragm is stretched over the above-mentioned diaphragm support.

According to the method of manufacturing the above-mentioned diaphragm assembly, it is possible to manufacture the diaphragm assembly in which the diaphragm is stretched over the diaphragm support in a situation where the central part of the diaphragm is dented to be concave.

In other words, according to the manufacture method of the present invention, it is possible to manufacture the diaphragm assembly which prevents the diaphragm from attaching to the fixed electrode, even if a high polarization voltage is applied to the fixed electrode.

According to the present invention, it is possible to provide the condenser microphone unit having the diaphragm assembly in which the diaphragm does not attach to the fixed electrode, even if the polarization voltage is increased.

Further, according to the present invention, it is possible to provide the method of manufacturing the diaphragm assembly in which the diaphragm does not attach to the fixed electrode, even if the polarization voltage is increased.

DESCRIPTION OF THE PREFERRED EMBODIMENTS

Hereinafter, a condenser microphone unit of a preferred embodiment in accordance with the present invention will be described with reference to the drawings.

Figure 7:
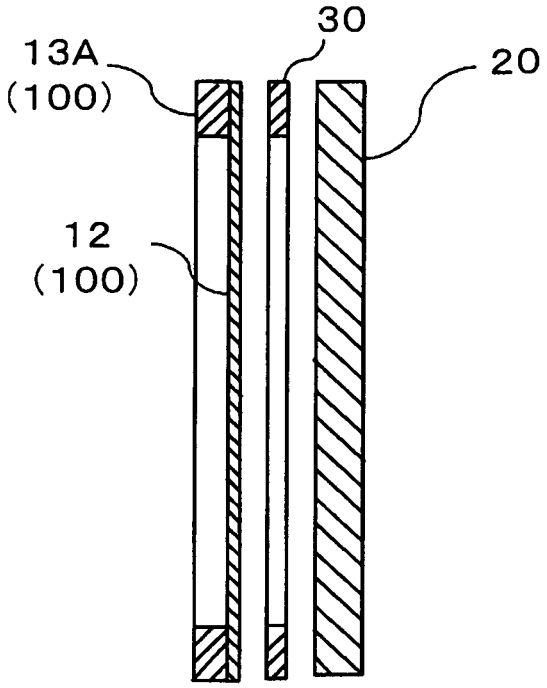
Fig.7 Prior Art
FIG. 7 is a sectional view showing a fundamental structure of a condenser microphone unit.
Figure 8:
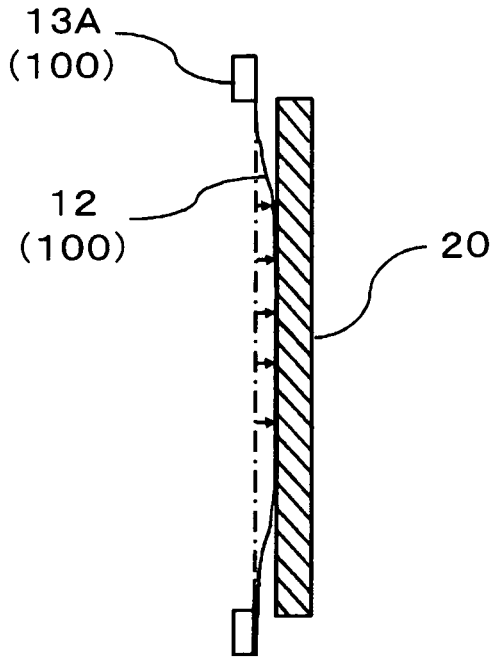
Fig.8 Prior Art
FIG. 8 is a schematic view showing a situation where the diaphragm of a conventional condenser microphone unit is attracted to and comes into contact with the fixed electrode.
Figure 9:
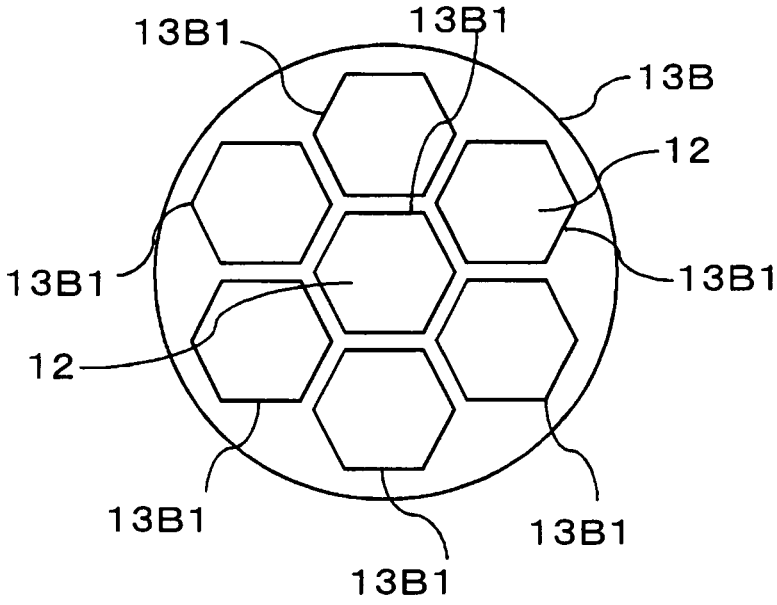
Fig.9 Prior Art
FIG. 9 is a front view of the diaphragm support of the conventional condenser microphone unit.
Figure 10:
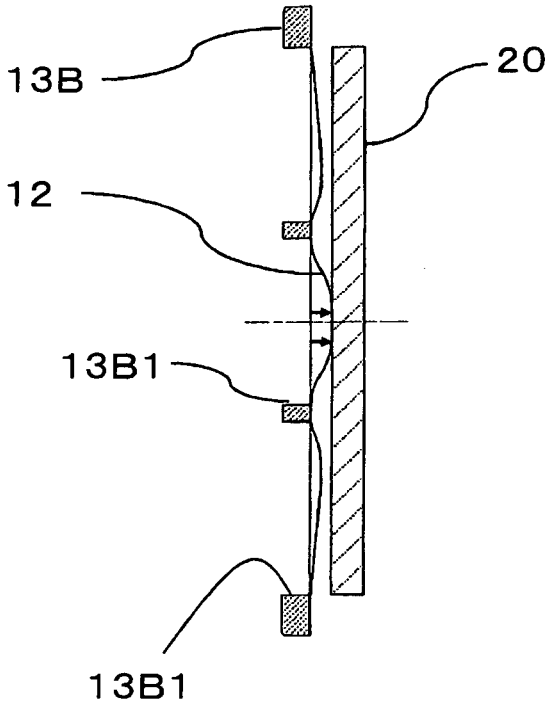
Fig.10 Prior Art
FIG. 10 is a schematic sectional view showing a situation where the diaphragm of the conventional condenser microphone unit is attracted to and comes into contact with the fixed electrode.

In addition, also in this preferred embodiment, a fundamental structure of the condenser microphone unit where a diaphragm assembly and a fixed electrode are arranged to face each other through a spacer ring is the same as that in FIG. 7 as described above. Further, the condenser microphone unit of this preferred embodiment has the same structure as that in FIG. 7 except for a diaphragm assembly 1.

Therefore, in the description of this preferred embodiment, the same reference signs are used for elements corresponding to those of the condenser microphone unit shown in FIG. 7, and the description thereof will not be repeated herein.

First, the structure of the condenser microphone unit of this preferred embodiment will be described with reference to FIGS. 1 to 4.

Figure 1:
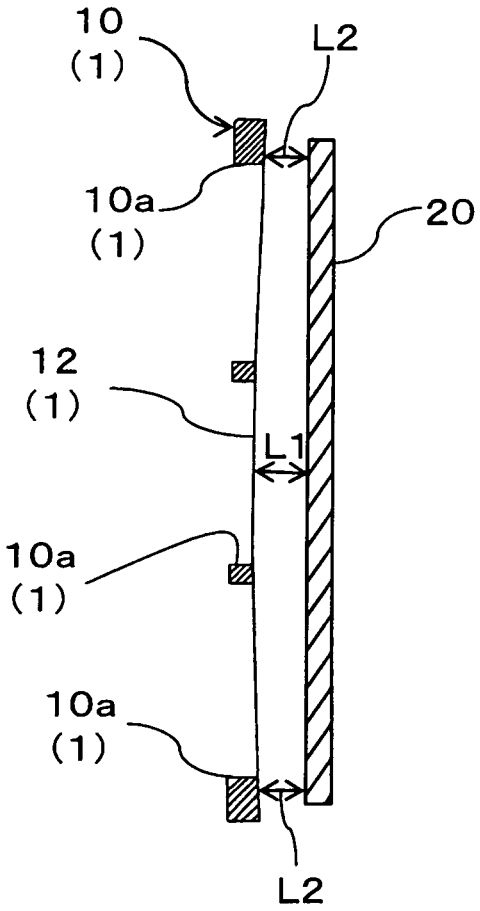
FIG. 1 is a schematic sectional view of a condenser microphone unit of a preferred embodiment in accordance with the present invention.
Figure 2:
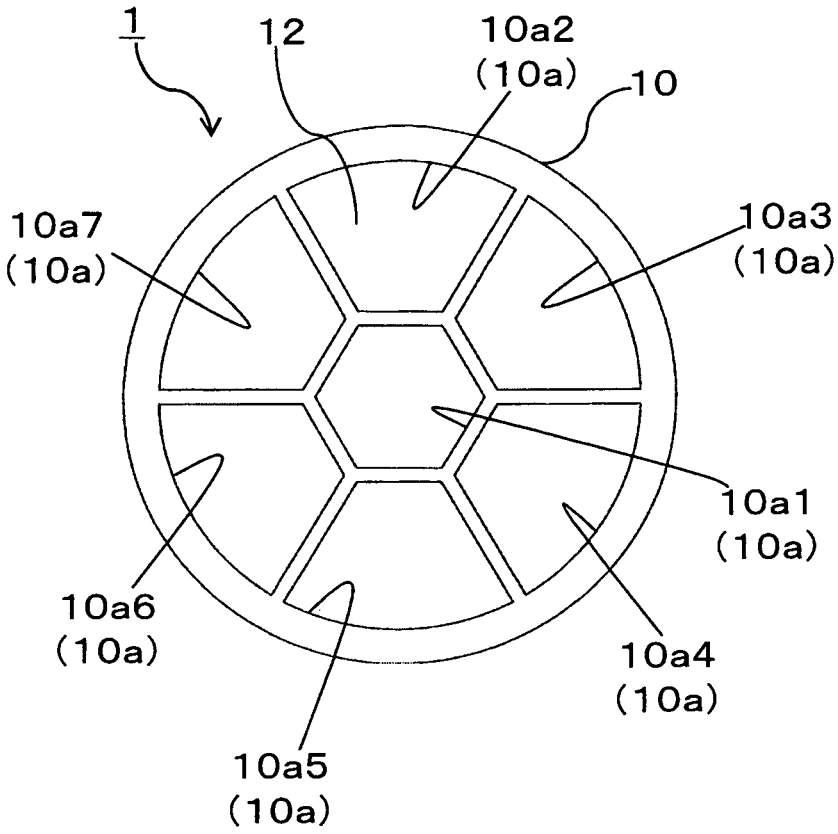
FIG. 2 is a front view of a diaphragm assembly of the preferred embodiment in accordance with the present invention.
Figure 3:
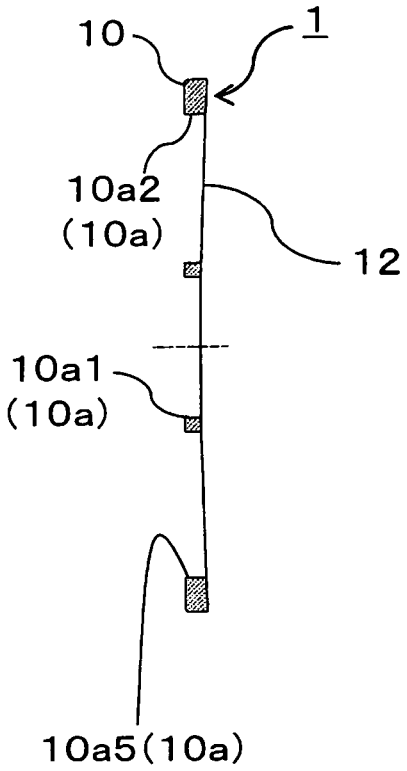
FIG. 3 is a schematic sectional view showing the diaphragm assembly of the preferred embodiment in accordance with the present invention.
Figure 4:
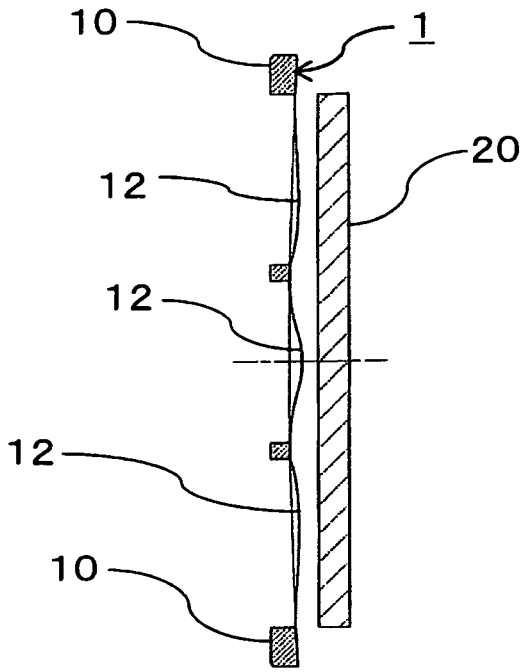
FIG. 4 is a schematic sectional view showing a situation where the diaphragm of the diaphragm assembly of the preferred embodiment in accordance with the present invention is attracted to a fixed electrode side.

FIG. 1 is a schematic sectional view of the condenser microphone unit of the preferred embodiment in accordance with the present invention. Further, FIG. 2 is a front view of the diaphragm assembly of the preferred embodiment in accordance with the present invention. Furthermore, FIG. 3 is a schematic sectional view showing the diaphragm assembly of the preferred embodiment in accordance with the present invention. Still further, FIG. 4 is a schematic sectional view showing a situation where the diaphragm of the diaphragm assembly of the preferred embodiment in accordance with the present invention is attracted to the fixed electrode side. In addition, for convenience of description, a spacer ring 30 is not shown in FIGS. 1 and 4.

As shown in FIG. 1, the microphone unit has the diaphragm assembly 1 which stretches the diaphragm 12 tightly over the metal diaphragm support 10, a fixed electrode 20, and the spacer ring 30 (not shown in FIG. 1), and the diaphragm assembly 1 and the fixed electrode 20 are arranged to face each other through the spacer ring 30.

Further, the diaphragm 12 whose central part is recessed to be concave is stretched over the diaphragm support 10 and the recessed concave is arranged to face the fixed electrode 20.

Furthermore, as shown in FIGS. 2 and 3, the diaphragm support 10 is formed in the shape of a disk, openings 10*a* are formed across the front and back, and the diaphragm 12 is adhered to one side of the diaphragm support, whereby the diaphragm 12 is stretched so as to be able to vibrate.

Still further, as shown in FIG. 3, the diaphragm support 10 is formed to be concave whose central part is recessed (formed in the shape of a circular arc). By this structure, the diaphragm support 10 can be stretched in a situation where the central part of the diaphragm 12 is recessed to be concave.

Yet further, the structure (shape and number) of the openings 10*a* of the diaphragm support 10 is not particularly limited, but it is desirable to employ a structure in which an effective vibrating area of the diaphragm 12 is increased as much as possible within a limited area of the diaphragm support 10.

In this preferred embodiment, the above-mentioned openings 10*a* are constituted by a plurality of through holes 10*a*1, 10*a*2, 10*a*3, 10*a*4, 10*a*5, 10*a*6, and 10*a*7, and the diaphragm support 10 allows the diaphragm 12 to be stretched so as to be able to vibrate partially.

In addition, in this preferred embodiment, the hexagonal through hole 10*a*1 is arranged in the center of the diaphragm support 10, and the through holes 10*a*2, 10*a*3, 10*a*4, 10*a*5, 10*a*6, and 10*a*7 are arranged at respective sides around the above-mentioned hexagonal through hole 10*a*1.

Further, each of the through holes 10*a*2, 10*a*3, 10*a*4, 10*a*5, 10*a*6, and 10*a*7 is generally in the shape of a trapezoid whose lower base is of a circular arc, and it is arranged in the center side so that its upper base may adjoin the hexagonal through hole 10*a*1.

Furthermore, the diaphragm support 10 is formed of metal, such as for example, brass and aluminum.

Still further, a size or dimension of the diaphragm support 10 is not particularly limited, but it is formed to have a diameter of around 16-20 mm in the case of a small unit, for example.

Yet further, a resin film having a metal deposition film on one side is used for the diaphragm 12.

In addition, a specific structure of the above-mentioned resin film is not particularly limited, but polymer films, such as PET (polyethylene terephthalate), PPS (polyphenylene sulfide), and PEN (polyethylene naphthalate), are preferably employed as the resin film, for example.

Further, the above-mentioned metal deposition film may only be one that is stretchable (expandable) (gold (Au) deposition film is optimal).

Furthermore, it is desirable that a thickness of the above-mentioned resin film is chosen from a range of 1-10 micrometers. Still further, it is preferable that a thickness of the above-mentioned metal deposition film is arranged to be between a few tens of Å and 1000 Å (inclusive). Yet further, the depositing method is generally vacuum deposition, but the other deposition methods may be employed.

While being subjected to predetermined tension, the diaphragm 12 is adhered to the diaphragm support 10 to provide a diaphragm having small areas and high resonance frequencies for each of the through holes 10*a*1, 10*a*2, 10*a*3, 10*a*4, 10*a*5, 10*a*6, and 10*a*7. These small-area diaphragms are equivalent to those connected together electrically in parallel.

According to the above-mentioned structure, as shown in FIG. 1, a spacing (distance L1) between the central part of the diaphragm 12 which is easy to attach to the fixed electrode 20 and the fixed electrode 20 can be increased.

In other words, in this preferred embodiment, the spacing (distance) between the diaphragm 12 and the fixed electrode 20 gradually increases along a direction from the perimeter of the diaphragm 12 towards the central part (L1>L2).

The reason why the structure in which the spacing (distance L1) between the central part of the diaphragm 12 and the fixed electrode 20 is selected to be large is as follows.

In particular, the present inventor has found that "stability (value indicating how well the diaphragm provides desired performance (sensitivity), without a fixed electrode attaching) to the attaching" is proportional to a third power (cube) of the above-mentioned spacing (distance L1) and is inversely proportional to a second power (square) of a polarization voltage and that the above-mentioned increased spacing is effective to prevent the diaphragm 12 from attaching to the fixed electrode 20.

In other words, by increasing the spacing (distance L1) between the central part of the diaphragm 12 and the fixed electrode 20, it is possible to prevent the diaphragm 12 from attaching to the fixed electrode 20 even if a high polarization voltage is applied across the diaphragm 12 and the fixed electrode 20, as shown in FIG. 4.

In addition, it is arranged that if the stability is greater than the predetermined range, the performance (sensitivity) of a microphone falls, and if it is smaller than the predetermined range, the diaphragm attaches to the fixed electrode.

Hereinafter, a method of manufacturing the diaphragm assembly 1 of the preferred embodiment will be described with reference to FIGS. 5A-5F.

Figure 5A:
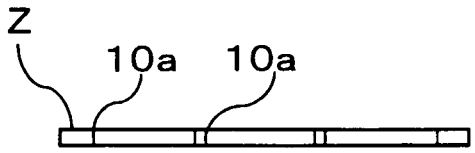
FIGS. 5A-5F are schematic views for explaining a process of manufacturing the diaphragm assembly of the preferred embodiment in accordance with the present invention.
Figure 5B:
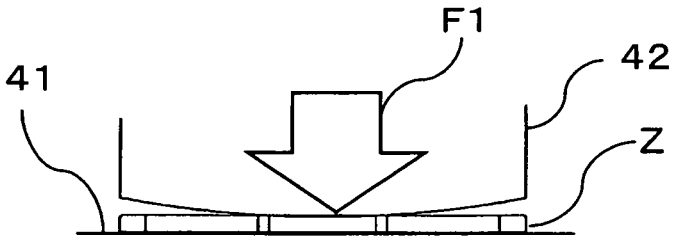
Figure 5C:
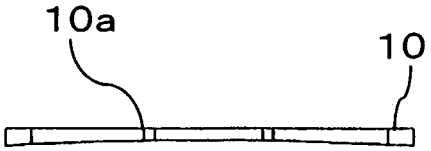
Figure 5D:
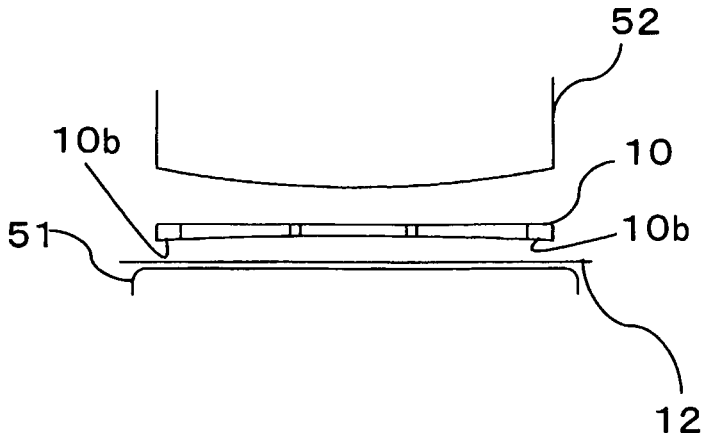
Figure 5E:
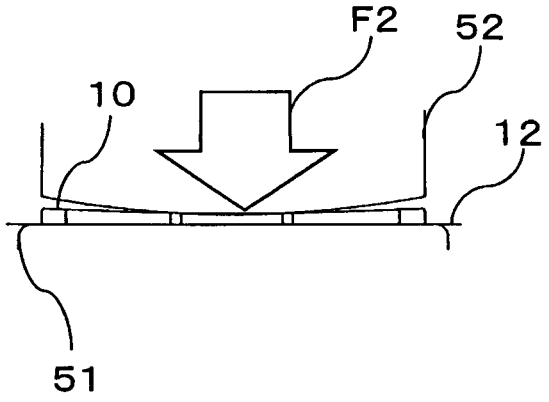
Figure 5F:
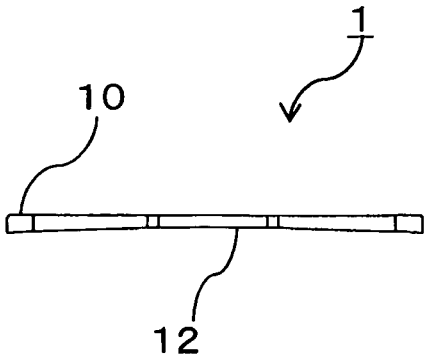

FIGS. 5A-5F are schematic views for explaining a process of manufacturing the diaphragm assembly of the preferred embodiment in accordance with the present invention. FIG. 5A is a schematic view showing a diaphragm support Z before being subjected to a polish process, where the central part is not recessed. FIG. 5B is a schematic view showing a process of polishing the diaphragm support Z. FIG. 5C is a schematic view showing the diaphragm support 10 after being subjected to the polish process. FIGS. 5D and 5E are schematic views showing an adhesion process of adhering the diaphragm 12 to the diaphragm support 10. FIG. 5F is a schematic view showing a situation where the diaphragm 12 is adhered to and stretched over the diaphragm support 10.

First, the polish process is carried out such that the diaphragm support Z whose central part is not recessed is polished to recess the central part.

In particular, as shown in FIG. 5A, the metal diaphragm support Z which is formed in the shape of a plate with an even thickness and has the openings 10*a* perforated across the front and back is prepared.

Further, as shown in FIG. 5B, the diaphragm support Z is placed on a surface plate 41, and the diaphragm support Z is polished by a pressure holder member 42 whose pressing side is formed in the shape of a circular convex applies stress to the central part of the diaphragm support Z.

When it is taken from the surface plate 42 after completion of the polish process, the diaphragm support 10 whose central side is dented compared with the perimeter is obtained as shown in FIG. 5C.

Next, the adhesion process of adhering the diaphragm 12 to the diaphragm support 10 is carried out.

In particular, as shown in FIG. 5D, the diaphragm 12 formed of the resin film provided with the metal deposition film is placed on a jig 51. Further, an adhesive is applied to one side (application side) 10*b* of the diaphragm support 10 whose central part is dented and which is obtained by way of the above-mentioned polish process, and the adhesive-applied side is brought into abutment with the diaphragm 12.

In addition, for example, a two-part epoxy adhesive can be used as the above-mentioned adhesive.

As shown in FIG. 5E, from the other side (opposite side of the above-mentioned application side 10*b*) of the diaphragm support 10, the diaphragm support 10 and the diaphragm 12 are pressed by a weight 52 whose tip portion is formed in the shape of a circular convex, whereby the diaphragm support 10 and the diaphragm 12 are depressed by the jig 51 and the weight 52 in a situation where a heavy load is applied to the central part.

Next, in a situation of FIG. 5E above, a curing process of heating the adhesive at 70° C. for about 2 hours to cure is carried out.

After curing the above-mentioned adhesive, the film protruding from the outer periphery is cut along the outer periphery of the diaphragm support 10, and the diaphragm assembly 1 is taken out of the jig 51.

As shown in FIG. 5F, the diaphragm assembly 1 is thus obtained in a situation where the diaphragm 12 whose central part is recessed to be concave is stretched over the diaphragm support 10.

As described above, according to this preferred embodiment, it is possible to provide the diaphragm assembly in which the diaphragm 12 is prevented from being pulled by electrostatic attraction and attaching to the fixed electrode 20 side, even if it is used for the condenser microphone which requires high sensitivity.

In addition, the present invention is not limited to the above-described preferred embodiments, but various modifications may be made within the scope of the invention.

Figure 6:
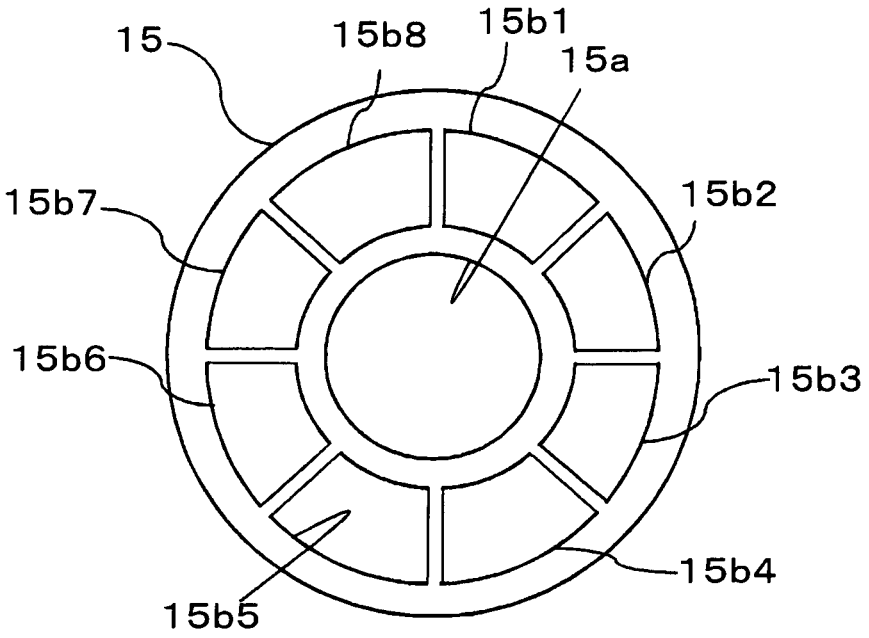
FIG. 6 is a schematic view showing a modification of a diaphragm support which constitutes the diaphragm assembly of the preferred embodiment in accordance with the present invention.

For example, a diaphragm support 15 shown in FIG. 6 may be used instead of the above-mentioned diaphragm support 10.

The diaphragm support 15 shown in FIG. 6 is formed in the shape of a disk, and a circular opening 15*a* across the front and back is formed in the central part of the diaphragm support 15. Further, as for the diaphragm support 15, a plurality of openings 15*b*1, 15*b*2, 15*b*3, 15*b*4, 15*b*5, 15*b*6, 15*b*7, and 15*b*8 perforated across the front and back are arranged around the perimeter of the circular opening 15*a* arranged in the central part of the diaphragm support 15.

Further, the openings 15*b*1, 15*b*2, 15*b*3, 15*b*4, 15*b*5, 15*b*6, 15*b*7, and 15*b*8 are arranged annularly around the perimeter of the opening 15*a*.

Furthermore, the diaphragm support 15 is formed to be concave in which its central part is recessed as with the diaphragm support 10.

According to the above-mentioned structure, as with the above-described diaphragm support 10, the diaphragm support 15 allows the diaphragm 12 to be stretched in a situation where its central part is dented and the concave is formed.

Therefore, even if the diaphragm assembly 1 is formed using the diaphragm support 15 instead of the above-described diaphragm support 10, it is possible to provide the diaphragm assembly which prevents the diaphragm 12 from attaching to the fixed electrode 20 as in the above-described preferred embodiment.

What is claimed is:

1. A condenser microphone unit comprising:

a diaphragm assembly including a diaphragm support shaped in a plate, and a diaphragm vibratably stretched over the diaphragm support and having a central part, the diaphragm support having a front surface portion, a back surface portion, a central portion and an opening, the opening being formed of a plurality of holes penetrating from the front surface portion toward the back surface portion; and a fixed electrode arranged away from the diaphragm assembly and facing said diaphragm assembly through a spacer arranged therebetween, wherein the central portion of the diaphragm support is curved in a direction away from the fixed electrode, and the diaphragm is adhered to the diaphragm support such that the central part of said diaphragm is curved in the direction away from the fixed electrode, and said central part of the diaphragm is arranged to face said fixed electrode.

2. The condenser microphone unit as claimed in claim 1, wherein one of said plurality of through holes is arranged in the center portion of said diaphragm support, and the others of the plurality of through holes are arranged around a perimeter of said one of the plurality of through holes arranged in the center portion.

3. The condenser microphone unit as claimed in claim 1, wherein the central portion of the diaphragm support is concavely curved in the direction away from the fixed electrode such that a distance between the diaphragm and the fixed electrode gradually increases in a direction from a perimeter of the diaphragm toward the central part of the diaphragm.

4. A condenser microphone unit comprising:

a diaphragm assembly including a diaphragm support having an inner annular portion, an outer annular portion, a plurality of radial portions radially extending from the inner annular portion to the outer annular portion, a central through hole formed in the inner annular portion, and a plurality of outer through holes, each outer through hole being formed between two of the plurality of radial portions, the inner annular portion being located in a plane away from a plane where the outer annular portion is positioned, and a diaphragm having a central part and vibratably stretched over the diaphragm support; and a fixed electrode arranged away from the diaphragm assembly and facing said diaphragm assembly through a spacer arranged therebetween, wherein the diaphragm is adhered to the diaphragm support such that the central part of said diaphragm is curved in the direction away from the fixed electrode, and faces said fixed electrode.

5. The condenser microphone unit as claimed in claim 4, wherein the inner annular portion is formed of a polygonal shape, and the plurality of radial portions extends from each vertex of the polygonal shape toward the outer annular portion.

* * * * *